US005263457A

United States Patent [19]

Konrath et al.

[11] Patent Number: 5,263,457

[45] Date of Patent: Nov. 23, 1993

[54] FUEL INJECTION PUMP FOR INTERNAL COMBUSTION ENGINES

[75] Inventors: Karl Konrath, Freiberg; Claus Koester, Ditzingen; Christin Taudt, Winnenden, all of Fed. Rep. of Germany; André Brunel, Genis Laval, France; Pierre Lauvin, Stuttgart, Fed. Rep. of Germany; Francois Quarret, Grezieu la Varenne, France

[73] Assignee: Robert Bosch GmbH, Stuttgart, Fed. Rep. of Germany

[21] Appl. No.: 5,932

[22] Filed: Jan. 15, 1993

Related U.S. Application Data

[63] Continuation of Ser. No. 721,603, Jul. 18, 1991, abandoned.

[30] Foreign Application Priority Data

Dec. 6, 1989 [DE] Fed. Rep. of Germany ..... 3940340
May 22, 1990 [DE] Fed. Rep. of Germany ..... 4016462

[51] Int. Cl.[5] ..... F02M 37/04
[52] U.S. Cl. ..... 123/502; 123/179.17
[58] Field of Search ..... 123/449, 502, 179.16, 123/179.17

[56] References Cited

U.S. PATENT DOCUMENTS

| | | | |
|---|---|---|---|
| 4,262,645 | 4/1981 | Kobayashi et al. | 123/179.17 |
| 4,333,437 | 6/1982 | Lohner et al. | 123/179.17 |
| 4,354,474 | 10/1982 | Kobayashi et al. | 123/179.17 |
| 4,408,591 | 10/1983 | Nakamura | 123/502 |
| 4,432,327 | 2/1984 | Salzgeber | 123/502 |
| 4,457,284 | 7/1984 | Salzgeber | 123/502 |
| 4,476,837 | 10/1954 | Salzgeber | 123/502 |
| 4,478,195 | 10/1984 | Dorenkamp et al. | 123/502 |
| 4,526,154 | 7/1985 | DiDomonico | 123/502 |
| 4,557,240 | 12/1985 | Sakuranaka | 123/502 |
| 4,573,444 | 3/1986 | Howes | 123/179.17 |
| 4,593,669 | 7/1986 | Igarashi | 123/502 |
| 4,594,989 | 6/1986 | Laufer | 123/502 |
| 4,748,958 | 7/1988 | Ash et al. | 123/449 |
| 4,753,211 | 6/1988 | Hofer | 123/179.17 |
| 4,932,385 | 6/1990 | Knorreck | 123/502 |
| 5,033,441 | 7/1991 | Hain | 123/179.17 |
| 5,138,999 | 8/1992 | Tomsett | 123/502 |
| 5,188,083 | 2/1993 | Zeisser et al. | 123/502 |
| 5,201,293 | 4/1993 | Eblen et al. | 123/502 |

FOREIGN PATENT DOCUMENTS

| | | | |
|---|---|---|---|
| 0305716 | 3/1989 | European Pat. Off. | 123/502 |
| 3201914 | 8/1983 | Fed. Rep. of Germany . | |
| 129623 | 1/1989 | Japan . | |
| 2054206 | 2/1981 | United Kingdom . | |
| 2188755 | 10/1987 | United Kingdom . | |

*Primary Examiner*—E. Rollins Cross
*Assistant Examiner*—Thomas N. Moulis
*Attorney, Agent, or Firm*—Michael J. Striker

[57] ABSTRACT

A fuel injection pump for internal combustion engines has an adjusting piston for adjusting an injection instant, is acted upon by a return force and delimits a working space, a control slide delimiting a pressure space in the adjusting piston and displaceable in the adjusting piston counter to a return force by a pressure-source supply pressure in the pressure space and controlled as a function of speed of the engine so that the working space can be connected to a pressure source or to a relief space, and so the supply pressure in the pressure space is additionally controlled as a function of further operating parameters of the engine. A feed pump delivering at a rate proportional to speed has a delivery side connected to the pressure space, a pressure line, containing a restriction, directly connects the delivery side of the feed pump to the pressure space so that the pressure is directly connected with the feed pump exclusively by the pressure line and is not connected with the inlet chamber. A discharge line is arranged for relieving the pressure space downstream of the restriction and having an element arranged in the discharge line for controlling the control pressure and influencing a flow a fuel from a delivery line, a pressure maintaining valve is arranged in the delivery line and enable passage to the inlet chamber only at a certain pressure at the delivery line, and a pressure control valve relieves the inlet chamber.

6 Claims, 2 Drawing Sheets

FUEL INJECTION PUMP FOR INTERNAL COMBUSTION ENGINES

This is a continuation of application Ser. No. 721,603 filed Jul. 18, 1991, now abandoned.

BACKGROUND OF THE INVENTION

The present invention relates to a fuel injection pump for internal combustion engines having an adjusting piston which serves for adjusting an injection instant.

A fuel injection pump of this kind has already been disclosed by German Offenlegungsschrift 3,201,914. For the adjustment of the injection instant, this fuel injection pump has an adjusting piston which is arranged in a cylinder in a manner displaceable counter to a return force and, in the said cylinder, delimits a working space. A control slide is arranged in a blind bore in the adjusting piston in a manner displaceable counter to a return spring which is supported via an adjustable support in the cylinder. In the blind bore, the control slide delimits a pressure space which is continuously connected to a fuel-filled inlet chamber for supplying the pump working space of the fuel injection pump, the said inlet chamber being subject to pressure control as a function of speed. Acted upon by the pressure in the inlet chamber, the control slide performs a speed-dependent adjusting movement, the working space being connected to the pressure space or to a relief space or being held closed, depending on the position of the control slide relative to the adjusting piston. In the case of a deflection of the control slide out of a position in which it closes the working space, the adjusting piston executes a movement which follows the control slide after corresponding pressurisation or relief of the working space, the said movement being terminated by the reclosure of the working space. An adjusting movement of the adjusting piston in the direction of an earlier or later injection instant is executed accordingly. In order to allow for further operating parameters of the internal combustion engine operated using the fuel injection pump, the support of the return spring of the control slide can be adjusted by a servomotor. However, the servomotor takes up a large amount of installation space. Furthermore, pressure fluctuations in the inlet chamber of the fuel injection pump have an effect on the adjustment of the injection instant.

SUMMARY OF THE INVENTION

In accordance with the present invention the fuel injection pump is designed so that a supply pressure prevailing in a pressure space has a control pressure and is additionally controlled as a function of further operating parameters of the internal combustion engine.

The fuel injection pump according to the invention has the advantage that further operating parameters of the internal combustion engine are taken into account in the control of the supply pressure and that no additional space-consuming and complicated adjusting device is required for taking account of further operating parameters.

In accordance with another feature of the present invention in the fuel injection pump the fuel is feed to an inlet chamber by a feed pump which serves as pressure source and delivers at a rate proportional to the speed, and in addition the delivery side of the feed pump is connected via a pressure line containing a restriction to the pressure space. It is possible to relieve the pressure space via a discharge line which leads off downstream of the restriction and in which, for the purpose of controlling the control pressure, an element which influences the flow is arranged. In this construction the supply pressure is produced in a simple manner and independently of the pressure prevailing in the inlet chamber of the fuel injection pump.

In accordance with a further feature of the present invention the discharge line can lead off directly from the pressure space, and a control slide can have a supply channel which is connected to one of axially successive control openings of the control slide. The control opening is connected to a part of a pressure line which is passed through the adjusting piston 11 and, upon displacement of the control slide relative to the adjusting piston, can be connected to a channel leading to the working space. With this construction, rapid filling of the working space after the beginning of operation of the fuel injection pump is achieved with low fuel consumption for the setting of the control pressure and hence an exact setting of the injection instant with early onset of said setting. In accordance with a further feature of the invention an even earlier setting of the injection instant, right upon starting of the internal combustion engine, as the fuel injection pump starts up, is made possible since a control pressure is set as a matter of priority before a speed-dependent pressure in the inlet chamber is built up.

In accordance with a further feature of the present invention the restriction is arranged in the connecting line and the pressure space can be relieved via a relief line which is passed through the adjusting piston and contains the control value controlled by a control device as a function of operating parameters of the internal combustion engine. With such a construction reliably functioning control, which is very simple to implement, of the beginning of injection is obtained without substantial changes having to be performed on a fuel injection pump of the generic type.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
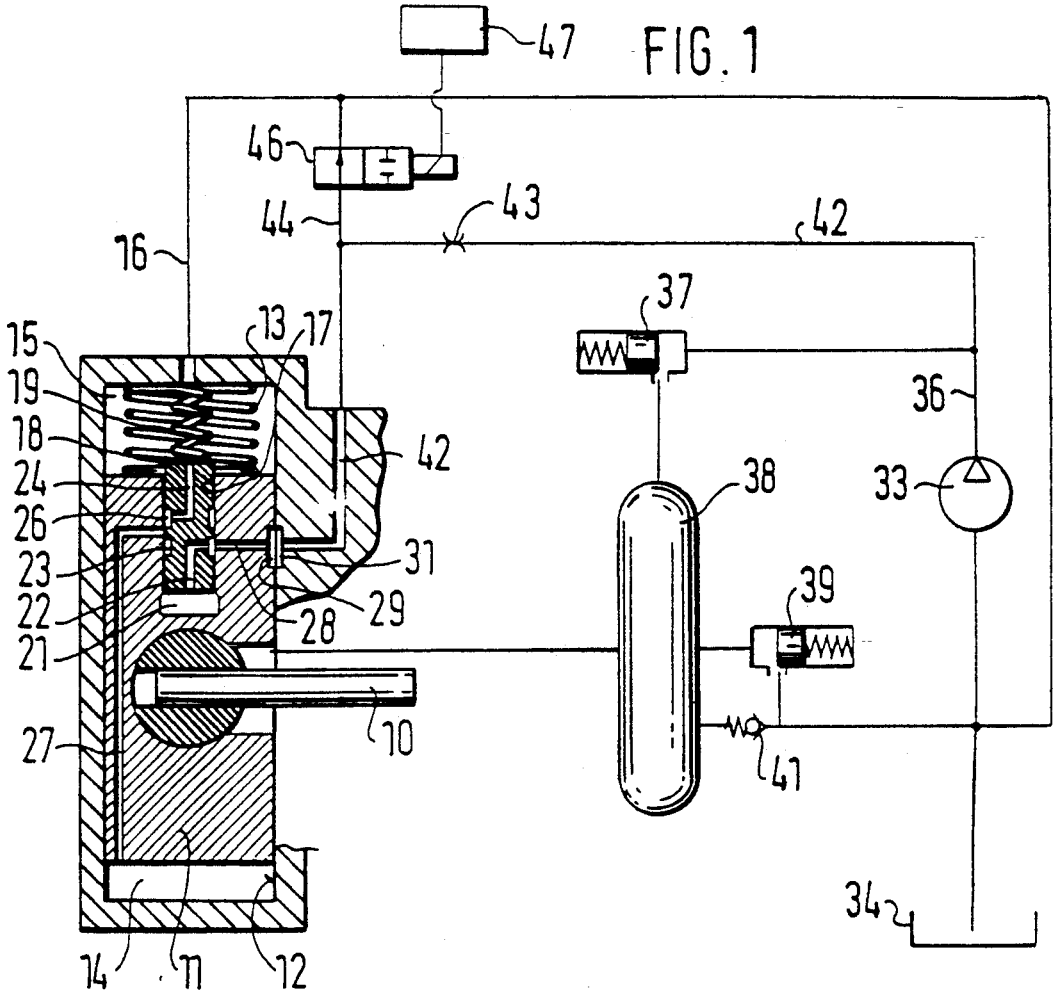
FIG. 1 shows a schematic representation of a fuel injection pump with a first illustrative embodiment, FIG. 2 with a second illustrative embodiment and FIG. 3 with a third illustrative embodiment.

For the adjustment of the injection instant, a fuel injection pump of known design has an adjusting piston 11 engaging via a pin 10 in a cam drive (not shown) of the fuel injection pump. The adjusting piston 11 can be displaced in an injection-adjusting cylinder 12 counter to the force of a return spring 13 and there delimits a working space 14 filled with fuel brought to a variable control pressure. The return spring 13 is arranged in a relief space 15, which is delimited by the adjusting piston on the other side and is relieved via a line 16. A control slide is arranged in the adjusting piston 11 displaceably in a coaxial blind bore 17, opening into the relief space 15. It is acted upon by a second return spring 19 in the injection-adjusting cylinder 12. The said second return spring is parallel to the return spring 13, and, at the end, delimits a pressure space 21 in the blind bore 17. The control slide 18 has a supply channel 22 which starts from its end face delimiting the pressure space 21 and opens in a first annular groove 23 in the lateral surface of the control slide 18, The annular groove serve as a control opening. A relief channel 24 of the control slide 18 starts from its end face facing the relief space 15 and opens in a second annular groove 26 serving as a control opening. The adjusting piston 11 has a channel 27 which starts from its end face delimiting the working space 14 and opens into the blind bore 17. Starting from the blind bore 17 there is furthermore a transverse bore 28 which opens into a longitudinal groove 29 in the lateral surface of the adjusting piston 11. The longitudinal groove 29 is connected to a groove 31 in the injection-adjusting cylinder 12, a supply-pressure line 42 opens into the groove 31 and is connected continuously to the transverse bore 28 via the longitudinal groove 29 and the groove 31 irrespective of the longitudinal position of the adjusting piston 11, secured against rotation by means of the pin 10.

Via the supply channel 22 and the first annular groove 23, the pressure space 21 is connected to the transverse bore 28 and hence to the supply-pressure line 42. Depending on the position of the control slide 18 relative to the adjusting piston 11, the working space 14 can be connected either to the supply-pressure line 42, via the channel 27 and the first annular groove 23, or to the relief space 15, via the second annular groove 26 and the relief channel 24, or can be closed by the lateral surface of the control slide 18 lying between the first and the second annular groove.

The fuel injection pump has a feed pump 33 which is driven proportionally to its driving speed, draws in fuel from a fuel tank 34 and delivers it into a feed-pump delivery line 36. Via the feed-pump delivery line 36 and a pressure-maintaining valve 37, an inlet chamber 38 of the fuel injection pump is filled with fuel. The pressure in the inlet chamber 38, from which the pump working space of the fuel injection pump is supplied with fuel, is controlled as a function of speed by a pressure control valve 39. The fuel can flow through the control valve 39 back to the intake side of the feed pump 33. The pressure-maintaining valve 37 in the feed-pump delivery line 36 here opens at a lower pressure than that controlled by the pressure control valve 39. A nonreturn valve 41 opening towards the interior space 38 is arranged in parallel with the pressure control valve 39. A pressure line 42 branches off from the feed-pump delivery line 36, upstream of the pressure-maintaining valve 37, and has a restriction 43. Downstream of the restriction 43, a discharge line 44 branches off from the pressure line 42 which leads to the injection-adjusting cylinder 12. Arranged in the discharge line 44 is a solenoid valve 46, the discharge line 44 can be relieved through the discharge line 44 to the intake side of the feed pump 33. The solenoid valve 46 is controlled by a control device 47 as a function of operating parameters, relevant to the start of injection, of an internal combustion engine operated using the fuel injection pump, such as, for example, load, temperature or acceleration. By means of the solenoid valve 46, the pressure prevailing in the supply-pressure line 42, as control pressure, is controlled to a value which lies between the pressure produced by the feed pump 33 and the pressure prevailing on the intake side of the feed pump 33.

The control pressure determines the position of the control slide 18 and simultaneously serves as actuating medium for adjusting the adjusting piston 11. As the control pressure increases, the control slide 18 is displaced out of the blind bore 17 and the working space 14 is subjected to the control pressure via the first annular groove 23, thereby the adjusting piston 11 is displaced counter to the force of the return spring 13, adjusting the injection instant in the "advance" direction. After a certain travel, the adjusting piston 11 moves over the first annular groove 23, with the result that the working space 14 is no longer connected to the supply-pressure line 42 and the adjustment motion of the adjusting piston 11 is thus stopped and the injection instant adjusted no further.

In the case where the control pressure is falling, the control slide 18 is pushed into the blind bore 17 by its return spring 19 and the working space 14 is connected to the relief space 15 via the second annular groove 26 and the relief channel 24, thereby fuel flows off from the working space 14. In the process, the adjusting piston 11 is displaced by the return spring 13 in the direction of a later injection instant until, after a certain travel, the adjusting piston 11 again moves over the second annular groove 26 and the working space 14 is separated from the relief space 15.

The supply pressure is independent of the pressure in the inlet chamber 38 since it is decoupled from the latter by the restriction 43, thereby pressure changes in the inlet chamber 38 do not fundamentally affect the adjustment of the injection instant. If only a speed-dependent adjustment of the injection instant is desired, the solenoid valve 46 remains closed and the control pressure is determined by the pressure in the inlet chamber. By virtue of the pressure-maintaining valve 37 in the feed-pump delivery line 36, a relatively high pressure is available early on as the fuel injection pump starts, for an advance of the injection instant, for the purpose of cold-starting the internal combustion engine, since the pressure-maintaining valve 37 only opens to the inlet chamber 38 at a certain pressure. Filling of the inlet chamber 38 with fuel can be accomplished via the nonreturn valve 41.

Figure 2:
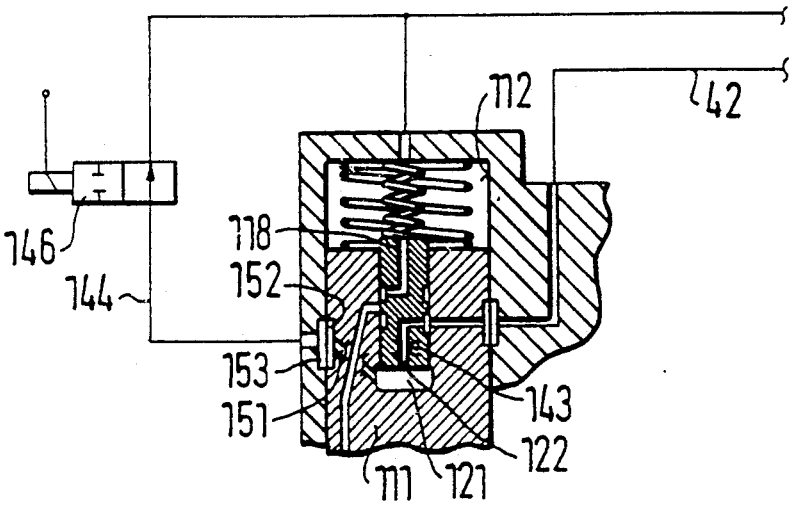

In contrast to the first illustrative embodiment, in a second illustrative embodiment depicted in FIG. 2 a restriction 143 corresponding to the restriction 43 is arranged in the supply channel 122. The restriction in the pressure line 42 is then omitted. The pressure space 121 delimited by the control slide 118 is connected via a bore 151 in the adjusting piston 111 and grooves 152 and 153 in the adjusting piston 111 and injection-adjusting cylinder 112, respectively, to the discharge line 144, in which the solenoid valve 146 is again arranged. In this arrangement of the restriction 143, rapid filling of the working space and hence rapid adjustment of the adjusting piston 111 is made possible since, in the appropriate position of the control slide 118, the said adjusting piston is connected without restriction to the delivery side of the feed pump. The setting of the control pressure is here limited to the very small volume of the pressure space 121 only and thereby, the pumping losses for the control of the control pressure can be kept very small. On the other hand the relatively higher, unmodified output pressure flows to the working space 114.

Figure 3:
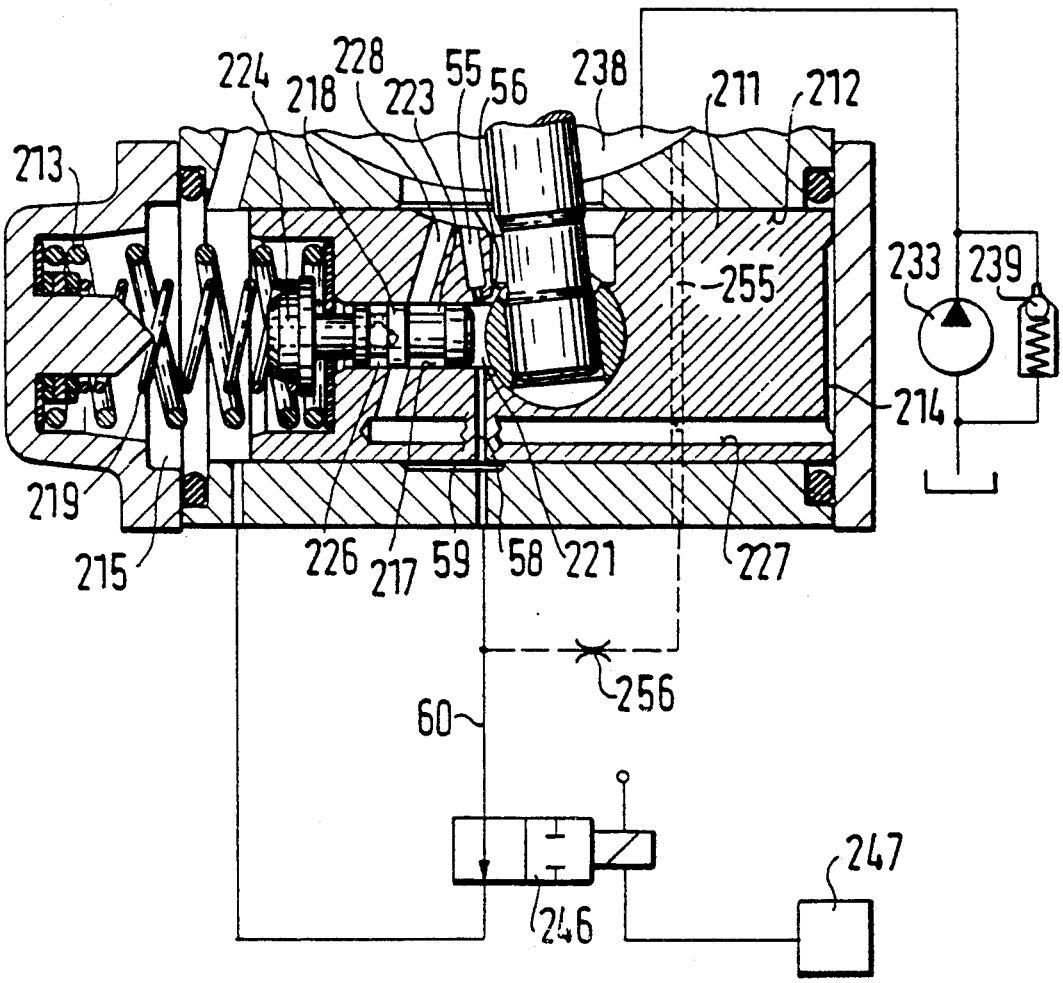

In a third illustrative embodiment depicted in FIG. 3, a displaceable adjusting piston 211 is again depicted in an injection-adjusting cylinder 212. In the injection-adjusting cylinder it delimits with one of its end faces the working space 214 and with its other end face the relief space 215, in which the return spring 213 of the adjusting piston is arranged. The control slide 218 is again arranged in the blind bore 217, the control slide being loaded by the return spring 219 and enclosing at the end the pressure space 221 in the blind bore 217. The channel 227 leading to the working space 214 is again controlled by the control slide. Depending on its position, the control slide here connects the channel 227, via an annular groove 223, to the transverse bore 228 in the adjusting piston or, via the annular groove 226 and via the relief channel 224 in the control slide, to the relief space 215. In a central position, the channel 227 is closed by the control-slide part between the two annular grooves 223 and 226.

In the example embodied, the transverse bore 228 opens at the outlet from the adjusting piston 211 into the inlet chamber 238 of the distributor-type fuel injection pump, this chamber is supplied by the pump 233 with fuel under speed-dependent pressure under the additional control of the pressure control valve 239. However, in the example embodied the pressure space 221 too is connected directly to the inlet chamber 238 via a connecting line 55 which extends in the adjusting piston 211 and contains a restriction 56. Finally, a relief line 58 in the adjusting piston leads off from the pressure space 221 and opens into an annular groove 59 in the injection-adjusting cylinder 212, which is connected via an onward-leading part 60 of the relief line to the relief space 215. The solenoid valve 246, which is controlled by the control device 247, is arranged in part 60 of the relief line.

The pressure space 221 is then supplied in a simplified manner directly from the inlet chamber 238, which serves as control-pressure source. The restriction 56 has a decoupling function, allowing the pressure in the pressure space 221 to be additionally altered beyond the scope of the speed dependence of the control pressure in the inlet chamber 238, to be specific with the aid of a controlled relief via the solenoid valve 246, which is preferably actuated in pulsed fashion. An analogue valve is of course also conceivable here. Depending on the pressure in the pressure space 221, the control slide 218 is thus displaced counter to its return spring 219. The adjusting piston 211 following this motion under the control of the annular grooves 226 and 223 and, a corresponding actuating pressure is set in the working space 214 until the channel 227 is again closed in the end position reached.

Instead of a connecting line 55 and an additional relief line 58 in the adjusting piston 211, it is also possible to use just one line 58. The connecting line 55 can be omitted and, instead, a connecting line 255 connected to the inlet chamber 238 via a restriction 256 opens between annular groove 59 and solenoid valve 246 into part 60 of the relief line, as illustrated in dashes in FIG. 3.

It will be understood that each of the elements described above, or two or more together, may also find a useful application in other types of constructions differing from the types described above.

While the invention has been illustrated and described as embodied in a fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection pump for internal combustion engines, comprising an adjusting piston which serves for adjusting an injection instant, is acted upon by a return force and delimits a working space; a control slide delimiting a pressure space in said adjusting piston and displaceable in said adjusting piston counter to a return force by a pressure-source supply pressure prevailing in said pressure space and controlled as a function of a speed of the internal combustion engine so that said working space can be connected to a pressure source or to a relief space, and so that said supply pressure prevailing in said pressure space as a control pressure being additionally controlled as a function of further operating parameters of the internal combustion engine; and inlet chamber; a feed pump which serves as a pressure source to deliver fuel to said inlet chamber and which delivers at a rate proportional to a speed, said feed pump having a delivery side connected to said pressure space; a pressure line directly connecting said delivery side of said feed pump to said pressure space so that said pressure is directly connected with said feed pump exclusively by said pressure line and it is not connected with said inlet chamber, said pressure line containing a restriction; a discharge line arranged for relieving said pressure space and leading off downstream of said restriction; an element arranged in said discharge line for controlling the control pressure and influencing a flow of fuel; a delivery line from which said feed pump delivers into said inlet chamber; a pressure maintaining valve arranged in said delivery line and enabling passage to said inlet chamber only at a certain pressure at said delivery line; and a pressure control valve through which said inlet chamber is relievable.

2. A fuel injection pump as defined in claim 1, wherein said element influencing the flow is a solenoid valve.

3. A fuel injection pump as defined in claim 1, wherein said discharge line leads off directly from said pressure space, said control slide having axially successive control openings and a supply channel connected to one of said axially successive control openings, said one control opening being connected to a part of said pressure line which is passed through said adjusting piston and, upon displacement of said control slide relative to said adjusting piston can be connected to said working space.

4. A fuel injection pump as defined in claim 3, and further comprising a channel leading to said working space, said one control opening upon displacement of said control slide relative to said adjusting piston can be connected to said channel leading to said working space.

5. A fuel injection pump as defined in claim 1, wherein said discharge line branches off from said pressure line, said control slide having axially successive control openings and a supply channel which is connected to one of said axially successive control openings, said one control opening being connected to a part of said pressure line which presses through said adjusting piston and, upon displacement of said control slide relative to said adjusting piston, can be connected to said working space.

6. A fuel injection pump as defined in claim 5; and further comprising a channel leading to said working space, said one control opening upon displacement of said control slide relative to said adjusting piston can be connected to said channel leading to said working space.

* * * * *